US012376690B2

(12) United States Patent
Yan

(10) Patent No.: US 12,376,690 B2
(45) Date of Patent: Aug. 5, 2025

(54) EVAPORATOR BASE PAN ASSEMBLY OF AN AIR-COOLED DISPLAY CABINET

(71) Applicant: Ningbo Rotor Electrical Appliances Co., Ltd., Ningbo (CN)

(72) Inventor: Jiguang Yan, Ningbo (CN)

(73) Assignee: Ningbo Rotor Electrical Appliances Co., Ltd., Ningbo (CN)

( * ) Notice: Subject to any disclaimer, the term of this patent is extended or adjusted under 35 U.S.C. 154(b) by 176 days.

(21) Appl. No.: 18/126,492

(22) Filed: Mar. 27, 2023

(65) Prior Publication Data

US 2024/0122376 A1 Apr. 18, 2024

(30) Foreign Application Priority Data

Oct. 18, 2022 (CN) ..... 202222758614.9

(51) Int. Cl.
*A47F 3/04* (2006.01)

(52) U.S. Cl.
CPC ..... *A47F 3/0482* (2013.01)

(58) Field of Classification Search
CPC .... F25D 23/006; F25D 17/067; F25D 23/003; F25D 2317/0651; F25D 2317/0661; A47F 3/0482; A47F 3/0408
See application file for complete search history.

(56) References Cited

U.S. PATENT DOCUMENTS

| | | | | |
|---|---|---|---|---|
| 8,141,378 | B2 * | 3/2012 | Hayase | A47F 3/0408 62/297 |
| 9,528,743 | B2 * | 12/2016 | Andersson | F25D 19/00 |
| 9,664,434 | B2 * | 5/2017 | Leong | F25D 21/14 |
| 2008/0180010 | A1 * | 7/2008 | Iguchi | F25D 29/005 312/401 |
| 2021/0207882 | A1 * | 7/2021 | Jurek | B60H 1/00364 |

FOREIGN PATENT DOCUMENTS

JP S60138186 U * 9/1985

* cited by examiner

*Primary Examiner* — Frantz F Jules
*Assistant Examiner* — Martha Tadesse
(74) *Attorney, Agent, or Firm* — Bayramoglu Law Offices LLC

(57) ABSTRACT

An evaporator base pan assembly of an air-cooled display cabinet is provided. The evaporator base pan assembly includes an enclosure, an evaporator base pan, and a ventilation panel that are arranged sequentially from bottom to top, where an outer side of the evaporator base pan extends outward and bends downward to form a hook portion; the evaporator base pan is hooked to an upper end of the enclosure through the hook portion; a bottom portion of the ventilation panel abuts on an upper edge of the evaporator base pan; the bottom portion of the ventilation panel extends downward to form a limiting portion; and the limiting portion is located on an outer side of the hook portion.

15 Claims, 5 Drawing Sheets

A

A

B

C

EVAPORATOR BASE PAN ASSEMBLY OF AN AIR-COOLED DISPLAY CABINET

CROSS REFERENCE TO THE RELATED APPLICATIONS

This application is based upon and claims priority to Chinese Patent Application No. 202222758614.9, filed on Oct. 18, 2022, the entire contents of which are incorporated herein by reference.

TECHNICAL FIELD

The present invention relates to a technology of an air-cooled display cabinet, and in particular to an evaporator base pan assembly of an air-cooled display cabinet.

BACKGROUND

An air-cooled display cabinet is a commodity display cabinet with a special function. Existing air-cooled display cabinets generally include a cabinet body, and an evaporator base pan is usually provided inside the cabinet body to hold an evaporator and a fan. The evaporator base pan is provided on a support frame such as an enclosure. The evaporator base pan is provided thereon with a ventilation panel. The ventilation panel is provided with an air inlet and an air outlet. The surface temperature of the evaporator is very low. When the fan is working, the cold air passing through the evaporator is discharged into the cabinet body from the air outlet of the ventilation panel. Under the action of the air pressure, the hot air in the cabinet body flows into the evaporator base pan through the air inlet of the ventilation panel. In this way, the cold air cooled by the evaporator continuously enters the cabinet body from the air outlet, and the hot air in the cabinet body continuously flows from the air inlet to the evaporator for cooling, thereby maintaining a low temperature in the cabinet.

The existing evaporator base pan assemblies of display cabinets on the market have different structures. However, basically, the evaporator base pan is provided on the support frame such as the enclosure, and the ventilation panel is provided on the evaporator base pan. During production, the evaporator base pan, the enclosure, and the ventilation panel are difficult to locate. In particular, the ventilation panel and the evaporator base pan are often fixed by simple bolts, and at least two locking bolts are required to complete orientation. Meanwhile, in order to prevent air leakage on the upper and lower assembly surfaces of the evaporator base pan, sealing materials such as sponge strips are needed. This increases material costs, affects production efficiency, and still has poor air leakage prevention effects.

SUMMARY

A technical problem to be solved by the present invention is to provide an evaporator base pan assembly of an air-cooled display cabinet. The present invention can effectively solve the problem that the assembly process of the evaporator base pan, the enclosure, and the ventilation panel is complex, and the assembly surfaces are prone to air leakage.

To solve the above technical problem, the present invention adopts the following technical solution.

An evaporator base pan assembly of an air-cooled display cabinet includes an enclosure, an evaporator base pan, and a ventilation panel that are arranged sequentially from bottom to top, where an outer side of the evaporator base pan extends outward and bends downward to form a hook portion; the evaporator base pan is hooked to an upper end of the enclosure through the hook portion; a bottom portion of the ventilation panel abuts on an upper edge of the evaporator base pan; the bottom portion of the ventilation panel extends downward to form a limiting portion; and the limiting portion is located on an outer side of the hook portion.

Preferably, abutting surfaces of the ventilation panel and the evaporator base pan are planar or curved surfaces that fit each other.

Preferably, an upper outer side of the enclosure is provided with a step groove; and a lower end of the hook portion abuts on an upper surface of the step groove.

Preferably, a lower end of the limiting portion abuts on the lower end of the hook portion, or the lower end of the limiting portion abuts on the upper surface of the step groove Preferably, the lower end of the hook portion of the evaporator base pan extends outward to form a first folded edge; and the first folded edge abuts on the upper surface of the step groove.

Preferably, the lower end of the limiting portion extends outward to form a second folded edge; and a lower surface of the second folded edge abuts on an upper surface of the first folded edge.

Preferably, the upper end of the enclosure extends inward and bends upward to form the step groove on the upper outer side of the enclosure; and a bottom portion of the first folded edge abuts on the step groove.

Preferably, an upper surface of the first folded edge and a lower surface of the second folded edge are planar or curved surfaces that fit each other.

Preferably, the hook portion includes a lateral extension portion connected with the upper edge of the evaporator base pan, a first longitudinal extension portion connected with the lateral extension portion, and the first folded edge connected with the first longitudinal extension portion; the limiting portion includes a second longitudinal extension portion connected with an outer edge of the ventilation panel, and also includes the second folded edge; and the first longitudinal extension portion and the second longitudinal extension portion have same draft angles.

Compared with the prior art, the evaporator base pan assembly of an air-cooled display cabinet in the present invention has the following advantages:

When the evaporator base pan and the enclosure are assembled, the outer hook portion of the evaporator base pan is directly overlapped on the upper end of the enclosure, making the assembly operation simple. When the ventilation panel and the evaporator base pan are assembled, the second folded edge of the ventilation panel is overlapped on the first folded edge of the evaporator base pan, making the assembly operation simple. The bottom portion of the ventilation panel abuts on the upper edge of the evaporator base pan, providing a first sealing effect. The second folded edge of the ventilation panel abuts on the first folded edge of the evaporator base pan, providing a second sealing effect. The design can effectively prevent the exchange of air inside and outside the evaporator base pan through assembly surfaces of the evaporator base pan and the ventilation panel. In addition, it simplifies the production process, and effectively ensures the air flow inside and outside the evaporator base pan, making the product more stable and energy-efficient.

Figure 1:
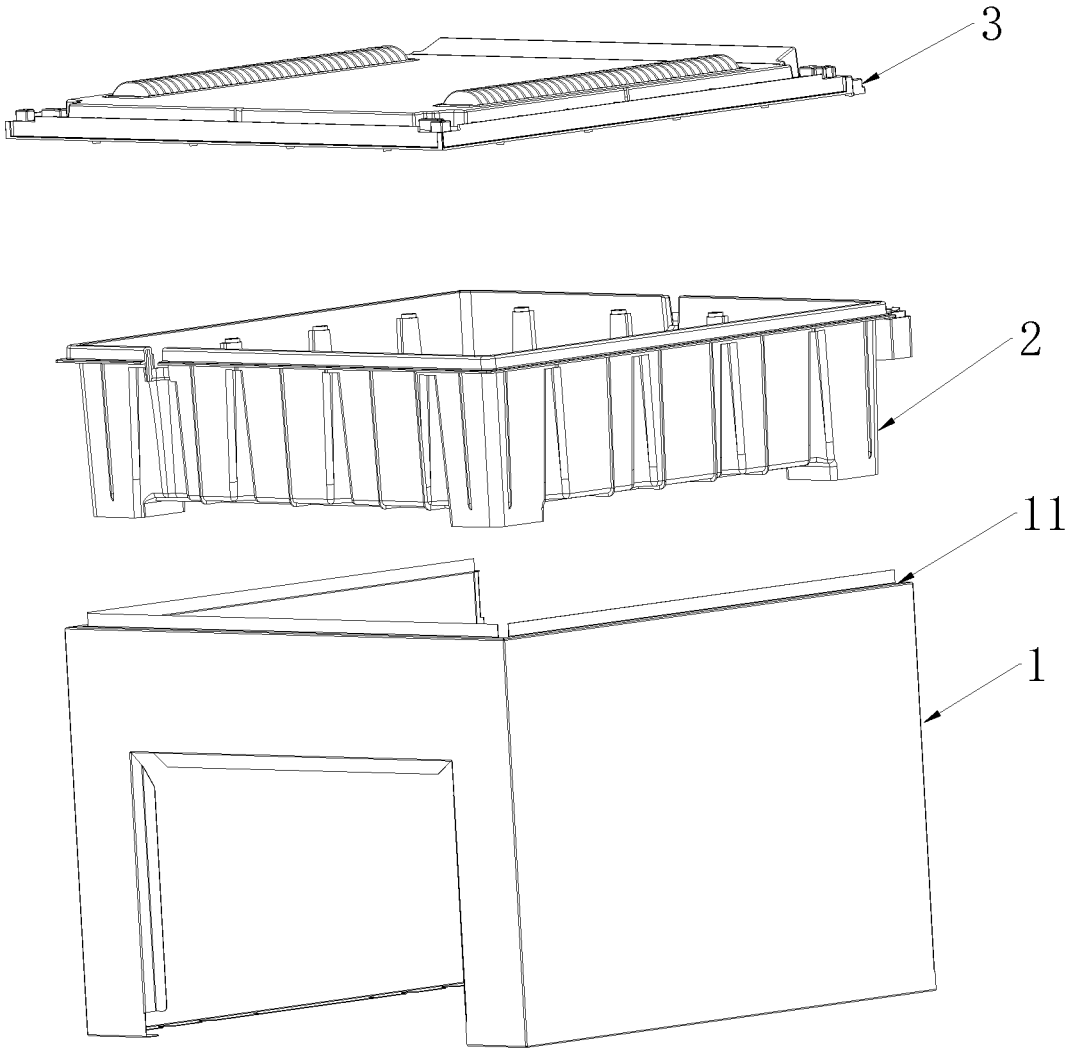
FIG. 1 is an exploded view of an evaporator base pan assembly of an air-cooled display cabinet according to an embodiment of the present invention.

Reference Numerals: 1. enclosure; 11. step groove; 2. evaporator base pan; 21. hook portion; 211. first folded edge; 212. lateral extension portion; 213. first longitudinal extension portion; 3. ventilation panel; 31. limiting portion; 311. second folded edge; 312. second longitudinal extension portion; 4. clamping assembly; 41. protrusion; and 42. recess.

DETAILED DESCRIPTION OF THE EMBODIMENTS

The present invention will be described in further detail below with reference to the drawings and embodiments.

Embodiment 1

Figure 2:
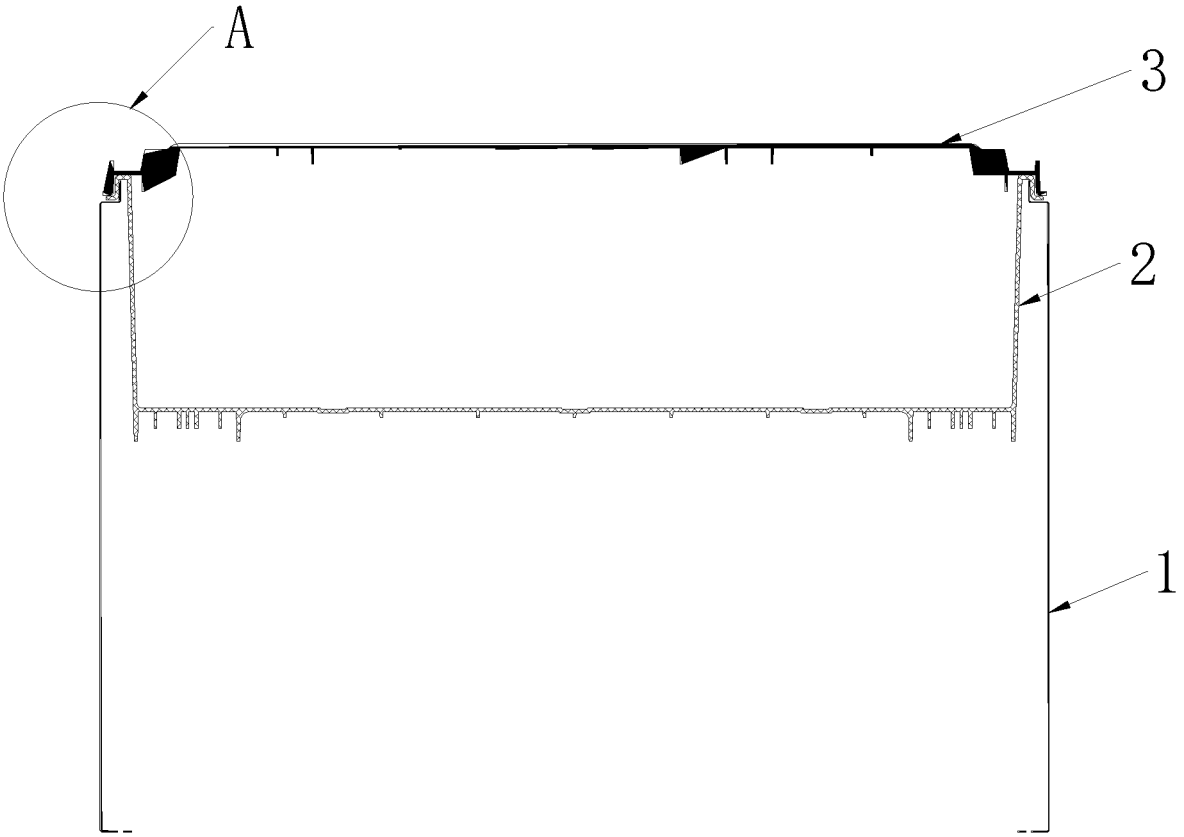
FIG. 2 is a structural diagram of the evaporator base pan assembly of an air-cooled display cabinet according to an embodiment of the present invention.
Figure 3:
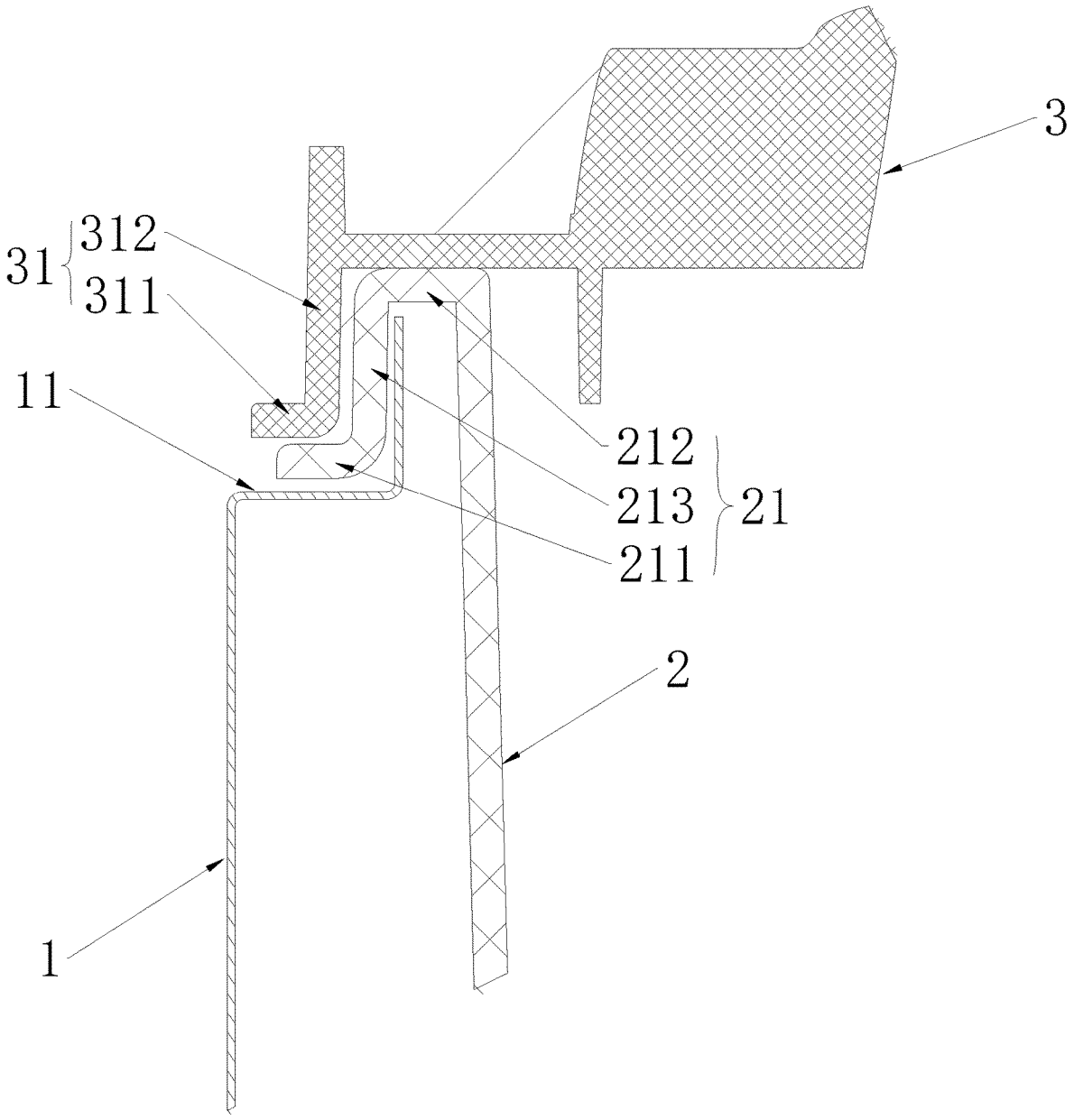
FIG. 3 is an enlarged view of A shown in FIG. 2.
Figure 4:
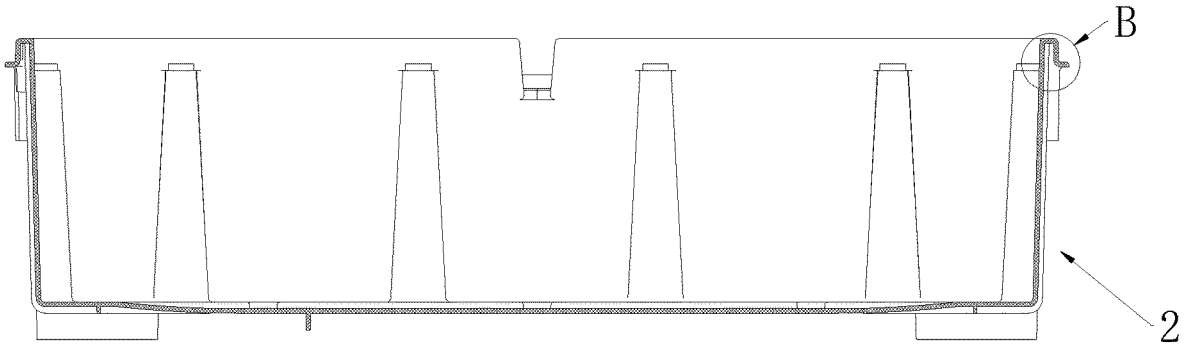
FIG. 4 is a structural diagram of an evaporator base pan according to an embodiment of the present invention.
Figure 5:
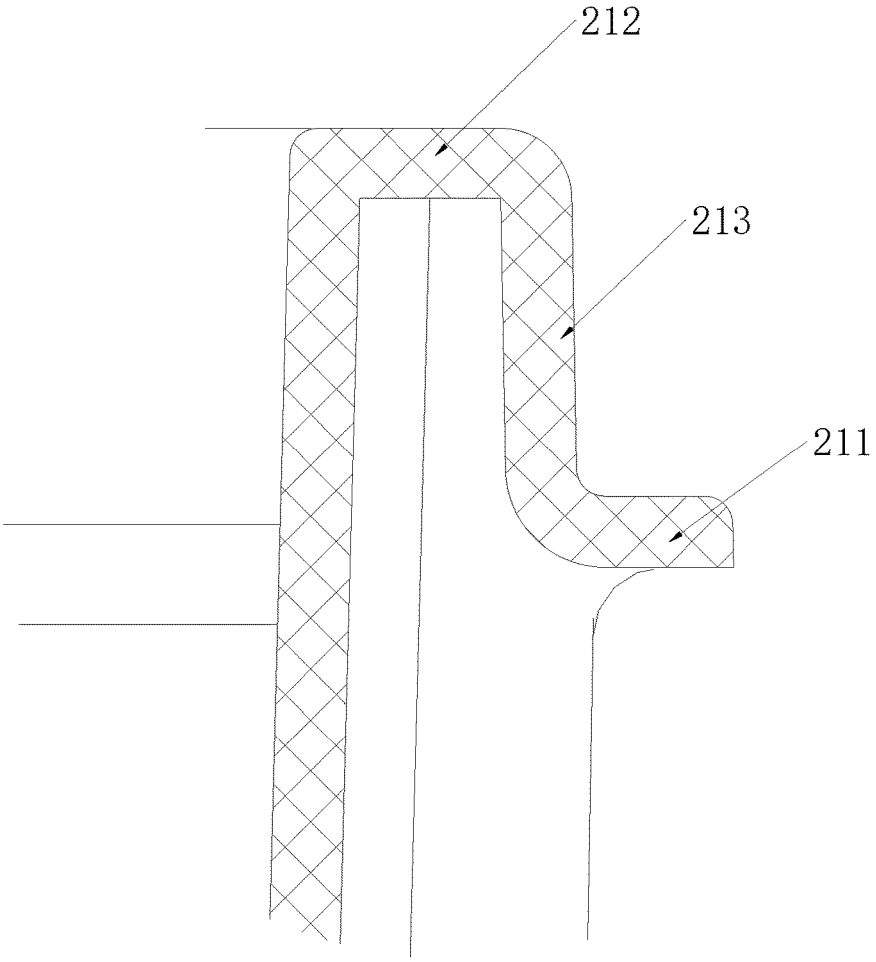
FIG. 5 is an enlarged view of B shown in FIG. 4.
Figure 6:
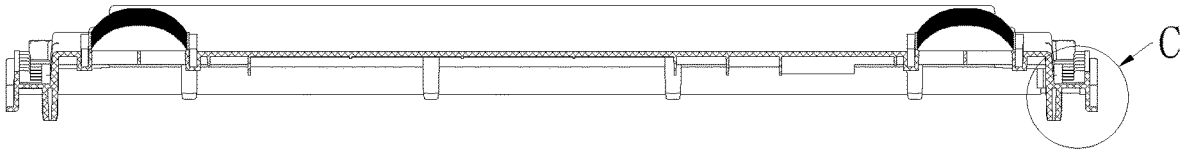
FIG. 6 is a structural diagram of a ventilation panel according to an embodiment of the present invention.
Figure 7:
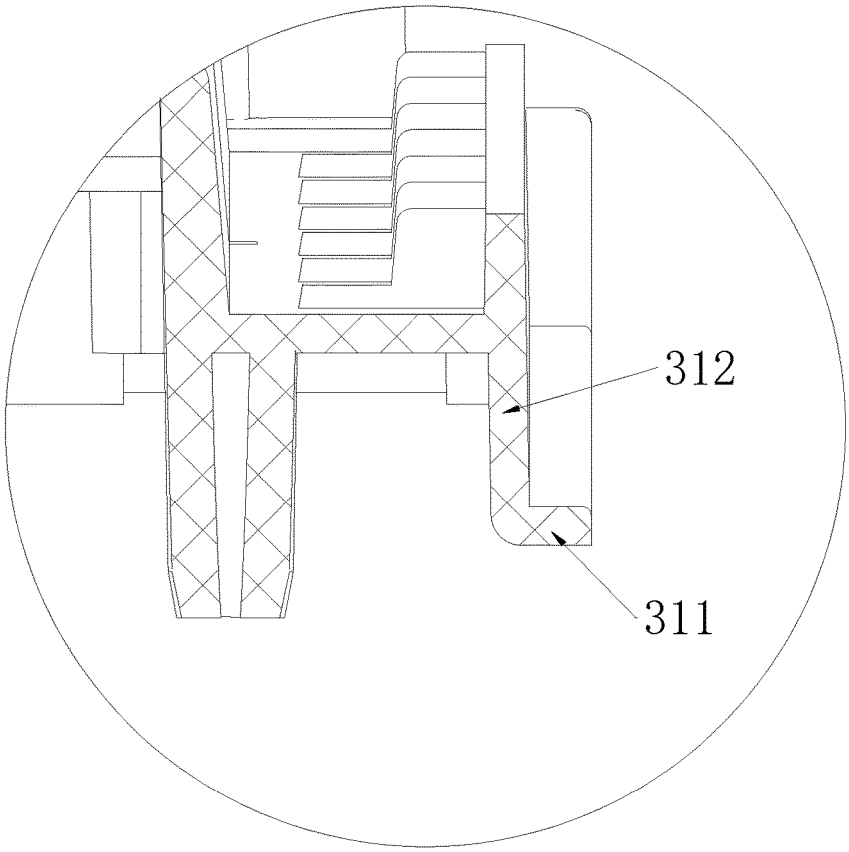
FIG. 7 is an enlarged view of C shown in FIG. 6.

As shown in FIGS. 1 to 7, an evaporator base pan assembly of an air-cooled display cabinet includes enclosure 1, evaporator base pan 2, and ventilation panel 3 that are arranged sequentially from bottom to top.

An outer side of the evaporator base pan 2 extends outward and bends downward to form hook portion 21. Specifically, the hook portion 21 includes lateral extension portion 212 connected with an upper edge of the evaporator base pan 2, first longitudinal extension portion 213 connected with the lateral extension portion 212, and first folded edge 211 connected with a lower end of the first longitudinal extension portion 213 and extending outward. The evaporator base pan 2 is hooked to an upper end of the enclosure 1 through the hook portion 21.

Those skilled in the art understand that in the optimal solution, the lateral extension portion 212 is connected with the upper edge of the evaporator base pan 2. Of course, the lateral extension portion 212 can also be directly connected with the outer side of the evaporator base pan 2.

A bottom portion of the ventilation panel 3 abuts on an upper edge of the evaporator base pan 2. Abutting surfaces of the ventilation panel 3 and the evaporator base pan 2 are planar or curved surfaces that fit each other, providing a first sealing effect. The bottom portion of the ventilation panel 3 extends downward to form limiting portion 31. The limiting portion 31 is located on an outer side of the hook portion 21. Specifically, the limiting portion 31 includes second longitudinal extension portion 312 connected with an outer edge of the ventilation panel 3 and second folded edge 311 connected with the second longitudinal extension portion 312 and extending outward.

An upper outer side of the enclosure 1 is provided with step groove 11. Specifically, the upper end of the enclosure 1 extends inward and bends upward, thereby forming the step groove 11 on the upper outer side of the enclosure 1. The first folded edge 211 of the evaporator base pan 2 abuts on the step groove 11, and a lower surface of the second folded edge 311 abuts on an upper surface of the first folded edge 211. The design provides a second sealing effect, effectively avoiding the exchange of air inside and outside the evaporator base pan 2 through assembly surfaces of the evaporator base pan 2 and the ventilation panel 3.

The upper surface of the first folded edge 211 and the lower surface of the second folded edge 311 are planar or curved surfaces that fit each other.

If the lower end of the first longitudinal extension portion 213 abuts on an upper surface of the step groove 11, a lower end of the limiting portion 31 abuts on a lower end of the hook portion 21, or the lower end of the limiting portion 31 abuts on the upper surface of the step groove 11. Those skilled in the art understand that the two design solutions can achieve the second sealing effect.

For production convenience, the first longitudinal extension portion 213 and the second longitudinal extension portion 312 have same draft angles.

Although the preferred embodiments of the present invention are described in detail above, those skilled in the art clearly understand that the present invention can have various changes and variations. Any modifications, equivalent substitutions, improvements, etc. made within the spirit and principle of the present invention should be included in the protection scope of the present invention.

What is claimed is:

1. An evaporator base pan assembly of an air-cooled display cabinet, comprising an enclosure, an evaporator base pan, and a ventilation panel, wherein the enclosure, the evaporator base pan, and the ventilation panel are arranged sequentially from a bottom to a top, wherein an outer side of the evaporator base pan extends outward and bends downward to form a hook portion;

the evaporator base pan is hooked to an upper end of the enclosure through the hook portion;

a bottom portion of the ventilation panel abuts on an upper edge of the evaporator base pan;

the bottom portion of the ventilation panel extends downward to form a limiting portion; and the limiting portion is located on an outer side of the hook portion, wherein abutting surfaces of the ventilation panel and the evaporator base pan are planar or curved surfaces, wherein the planar or curved surfaces fit each other.

2. An evaporator base pan assembly of an air-cooled display cabinet, comprising an enclosure, an evaporator base pan, and a ventilation panel, wherein the enclosure, the evaporator base pan, and the ventilation panel are arranged sequentially from a bottom to a top, wherein an outer side of the evaporator base pan extends outward and bends downward to form a hook portion;

the evaporator base pan is hooked to an upper end of the enclosure through the hook portion;

a bottom portion of the ventilation panel abuts on an upper edge of the evaporator base pan;

the bottom portion of the ventilation panel extends downward to form a limiting portion; and the limiting portion is located on an outer side of the hook portion, wherein an upper outer side of the enclosure is provided with a step groove; and a lower end of the hook portion abuts on an upper surface of the step groove.

3. The evaporator base pan assembly according to claim 2, wherein a lower end of the limiting portion abuts on the lower end of the hook portion, or the lower end of the limiting portion abuts on the upper surface of the step groove.

4. The evaporator base pan assembly according to claim 2, wherein the lower end of the hook portion of the evaporator base pan extends outward to form a first folded edge; and the first folded edge abuts on the upper surface of the step groove.

5. The evaporator base pan assembly according to claim 4, wherein the lower end of the limiting portion extends outward to form a second folded edge; and a lower surface of the second folded edge abuts on an upper surface of the first folded edge.

6. The evaporator base pan assembly according to claim 4, wherein the upper end of the enclosure extends inward and bends upward to form the step groove on the upper outer side of the enclosure; and a bottom portion of the first folded edge abuts on the step groove.

7. The evaporator base pan assembly according to claim 5, wherein an upper surface of the first folded edge and a lower surface of the second folded edge are planar or curved surfaces, wherein the planar or curved surfaces fit each other.

8. The evaporator base pan assembly according to claim 5, wherein the hook portion comprises a lateral extension portion connected with the upper edge of the evaporator base pan, a first longitudinal extension portion connected with the lateral extension portion, and the first folded edge connected with the first longitudinal extension portion; the limiting portion comprises a second longitudinal extension portion and the second folded edge, wherein the second longitudinal extension portion is connected with an outer edge of the ventilation panel; and the first longitudinal extension portion and the second longitudinal extension portion have same draft angles.

9. The evaporator base pan assembly according to claim 1, wherein an upper outer side of the enclosure is provided with a step groove; and a lower end of the hook portion abuts on an upper surface of the step groove.

10. The evaporator base pan assembly according to claim 9, wherein a lower end of the limiting portion abuts on the lower end of the hook portion, or the lower end of the limiting portion abuts on the upper surface of the step groove.

11. The evaporator base pan assembly according to claim 9, wherein the lower end of the hook portion of the evaporator base pan extends outward to form a first folded edge; and the first folded edge abuts on the upper surface of the step groove.

12. The evaporator base pan assembly according to claim 11, wherein the lower end of the limiting portion extends outward to form a second folded edge; and a lower surface of the second folded edge abuts on an upper surface of the first folded edge.

13. The evaporator base pan assembly according to claim 11, wherein the upper end of the enclosure extends inward and bends upward to form the step groove on the upper outer side of the enclosure; and a bottom portion of the first folded edge abuts on the step groove.

14. The evaporator base pan assembly according to claim 12, wherein an upper surface of the first folded edge and a lower surface of the second folded edge are planar or curved surfaces, wherein the planar or curved surfaces fit each other.

15. The evaporator base pan assembly according to claim 12, wherein the hook portion comprises a lateral extension portion connected with the upper edge of the evaporator base pan, a first longitudinal extension portion connected with the lateral extension portion, and the first folded edge connected with the first longitudinal extension portion; the limiting portion comprises a second longitudinal extension portion and the second folded edge, wherein the second longitudinal extension portion is connected with an outer edge of the ventilation panel; and the first longitudinal extension portion and the second longitudinal extension portion have same draft angles.

* * * * *